United States Patent [19]

Yang et al.

[11] Patent Number: 4,928,432

[45] Date of Patent: May 29, 1990

[54] RODS PRECISION CUTTING-OFF AND END SURFACE GRINDING MACHINE

[76] Inventors: Chin-lung Yang, 9 Lane 166, Chimei St., Sanchung City, Taipei Hsien; Chung-tien Lee, 78 Lane 29, Huacheng Road, Hsinchuang City, Taipei Hsien, both of Taiwan

[21] Appl. No.: 237,844

[22] Filed: Aug. 29, 1988

[51] Int. Cl.[5] ..... B24B 27/06

[52] U.S. Cl. ..... 51/5 C; 51/91 R; 51/96; 51/124 R; 51/234

[58] Field of Search ..... 51/3, 5 C, 91 R, 96 R, 51/124 R, 115, 289, 290, 326, 217 S

[56] References Cited

U.S. PATENT DOCUMENTS

| | | | |
|---|---|---|---|
| 798,538 | 8/1905 | Stedman | 51/124 |
| 2,151,528 | 3/1939 | Preston | 51/217 S |
| 2,248,262 | 7/1941 | Wilhide | 51/217 S |
| 2,382,257 | 8/1945 | Ramsay | 51/3 |

FOREIGN PATENT DOCUMENTS

| | | | |
|---|---|---|---|
| 0313462 | 5/1918 | Fed. Rep. of Germany | 51/124 |

*Primary Examiner*—Robert Rose

[57] ABSTRACT

A rods precision cutting-off and end surface grinding machine consisting chiefly of a set each of drive device, cut-off device, end surface grinding device and rods chucking device, which is chiefly characterized by the following operations: to put the controlling lever of rods chucking device in the central position of T-slot on the right side wall of housing body and move the said lever in the right horizontal direction along the said slot so that the arced cam at the front end of said lever pushes the secondary chuck body to open its mouth to receive a rod, then to move the said lever back to its original position and then up and down along the said T-slot so that the pincer fixture of rods chucking device can chuck the rod to be precisely cut off by the cut-off device and then the end surface of said rod cut off is precisely ground by the end surface grinding device, therefore, the rod can be precisely cut off or shortened and the end surface thereof can be ground and flattened at the same time.

3 Claims, 9 Drawing Sheets

RODS PRECISION CUTTING-OFF AND END SURFACE GRINDING MACHINE

BACKGROUND OF THE INVENTION

Nowadays the conventional machine tools such as sander cutting-off machine, sawing machine or lathe are used to cut off or shorten the rods for the punch of punching die or the knockout bar of plastic die, and then the conventional grinding machine is used to grind the cut-off end surface of said rods up to the required precision length. However, it is difficult to cut off the said rods and grind the end surface thereof up to the required length with exact precision in the foregoing conventional manner, and even repeated measuring and grinding still cannot achieve the required precision length; and particularly, sometimes such phenomena will take place: the end surface of ground rods is not perpendicular to the axial center thereof, or even the rods are ground up to unduely short as an unserviceable salvage, so a new rod has to be cut off and ground. Therefore, this is rather wasting time, labour and material.

We inventors have been engaged in the plastic injection and extrusion molding as well as machinery and dies manufacturing and processing for many a year. In view of no special machine tool for precision cut-off and shortening of rods such as the punch of punching die or the knockout bar of plastic die and for grinding and flatening the end surface of said rods, and the conventional manner with the foregoing disadvantages, the present inventors mutually studied to manufacture and try the present invention which is a successful and practical "rods precision cutting-off and end surface grinding machine".

BRIEF SUMMARY OF THE INVENTION

The present invention is related to a precision cutting-off and end surface grinding machine for the rods such as the punch for the punching dies and the knockout bar for the plastic dies, and particularly to a rods precision cutting-off and end surface grinding machine capable of quickly cutting off the rods up to an exact length and grinding the end surface of cut-off rods. Chiefly it consists of a set each of drive device, cut-off device, end surface grinding device and rods chucking device installed in a housing.

DETAILED DESCRIPTION

Figure 1:
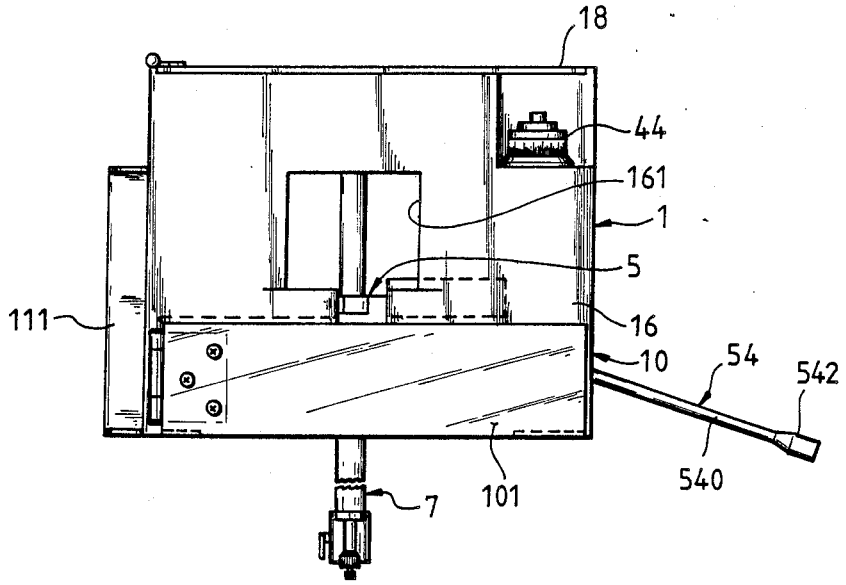
FIG. 1 is a plan of the present invention.
Figure 2:
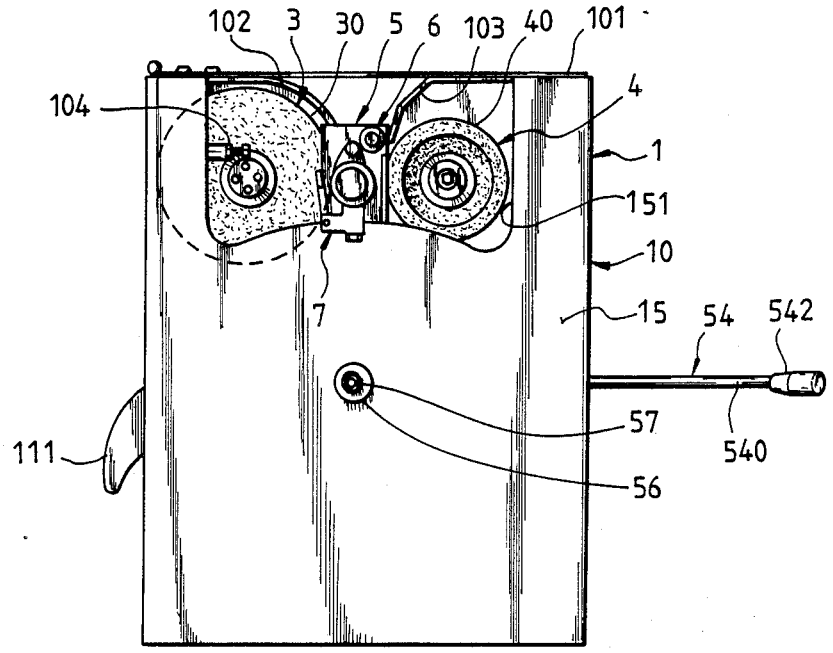
FIG. 2 is a front view of the present invention.
Figure 3:
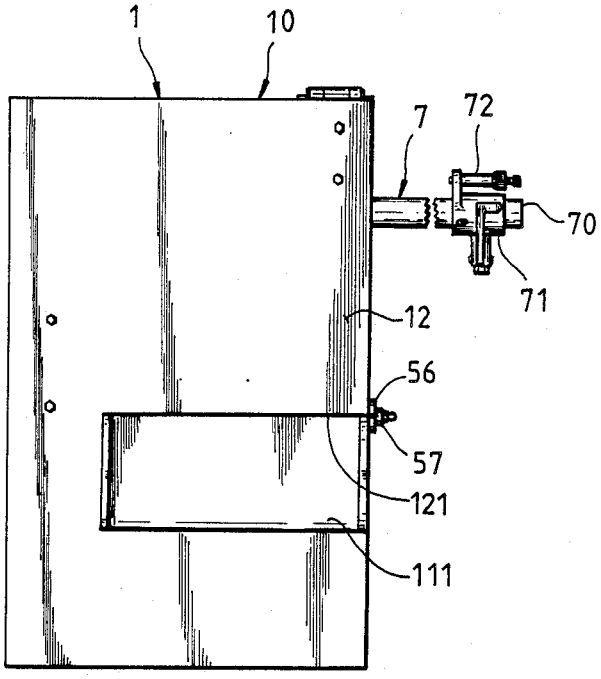
FIG. 3 is a left side view of the present invention.

The preferred embodiment of the present invention can be best described in detail in conjunction with the accompanying drawings hereinafter.

As shown in FIG. 1 through 5, the rods precision cutting-off and end surface grinding machine of the present invention consists chiefly of a set each of drive device 2, cut-off device 3, end surface grinding device 4 and rods chucking device 5 installed in a housing 1.

As shown in FIG. 1 through 5 and 11 through 14, the housing 1 is roughly a rectangular housing body 10 wherein an inclined partition 11 in the shape of a ramp is designed for the remainder of rods cut off and fallen down, the bottom end of said partition 11 extends to the outer side of left side wall 12 of said housing body 10, a U-shaped discharge hopper 111 with supporting edge on its two sides is installed on the said left side wall 12 where a notch 121 is provided to let the said remainder falling along the said partition 11 pass through the notch 121 and fall down from the said hopper 111; a plurality of longitudinal and lateral partitions 13, 13', 13" and 14, 14', 14" with suitable height and length are provided so that a set each of cut-off device 3 and end surface grinding device 4 are installed between these six partitions on the two upper sides of said body 10 respectively, and a set of rod chucking device 5 is installed between these two devices 3 and 4, and the transmission member of said drive device 2 installed in the surplus space on the back side of lateral partition 14 is designed for the transmission of said two devices 3 and 4. Two notches 151, 161 with suitable shape and dimensions are provided to the centers of the upper side of front side wall 15 and upper wall 16 of said body 10 respectively so that the rods can be easily disposed on the rods chucking device 5 for chucking and removing thereby as well as installing the cut-off sander and cylindrical grinding sander on the cut-off device 3 and the end surface grinding device 4 and removing the said sanders therefrom; a T-slot 171 is provided to the right side wall 17 of said body 10 so that the controlling rod 52 of rods chucking device 5 extends to the outer side of said body 10 for the operator to chuck and release the rods and to cut off and grind the end surface thereof; and a rear cover plate 18 capable of optionally opening and closing is pivotally installed on the back side of said body 10 so that various devices therein can be inspected for maintenance or filling oil from time to time.

Figure 5:
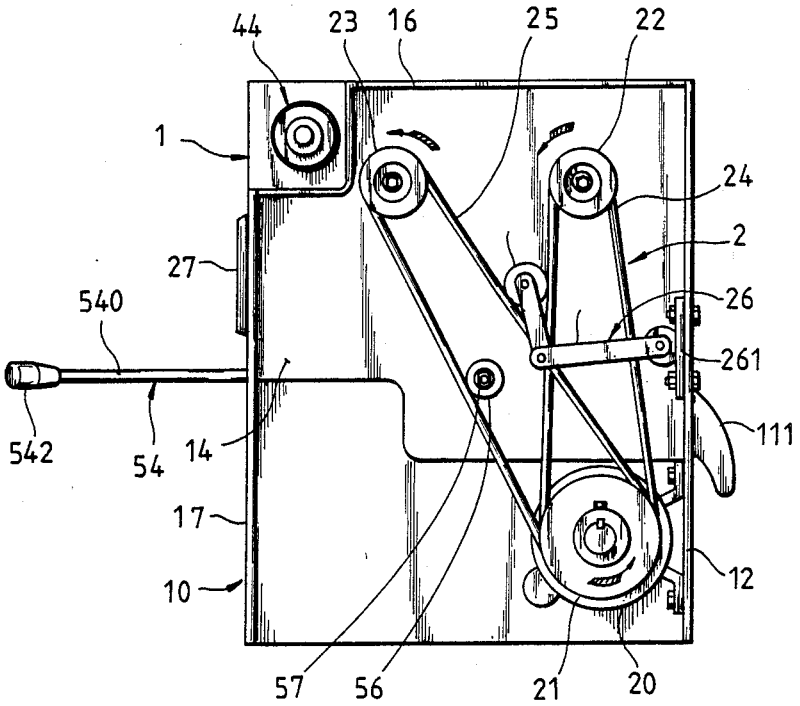
FIG. 5 is a back view of the present invention after opening the rear cover of housing.

As shown in FIG. 5, the drive device 2 consists chiefly of a motor 20, a drive double-grooved belt roller 21, two driven single-grooved belt rollers 22, 23, two transmission belts 24, 25, and a set of belt automatic tension adjuster 26, wherein the motor 20 is installed in a suitable position on the lower side of a side wall 12 of said body 10 and provided with a conducting wire or plug for connecting the power source (not shown in the drawing), and a switch 27 for turning on and off the power source is installed on one side wall 17 of said body 10; the two driven single-grooved belt rollers 22, 23 are installed on the drive shafts 31, 41 of cut-off device 3 and end surface grinding device 4 respectively, two belts 24, 25 are connected to the said drive double-grooved belt roller 21 so that when the motor 20 is started to actuate running the said roller 21 on the shaft of motor 20, the two rollers 22, 23 can be driven to actuate running the cut-off device 3 and end surface grinding device 4 respectively; and the said adjuster 26 consists of a L-rod 260 capable of freely extending and folding, a bearing seat 261 pivotally installed one end of said L-rod 260 and fixed on the inner side of a side wall 12 of said body 10, and a movable roller 262 installed on another end thereof between the two transmission rollers 24, 25, of which the tightness with load during simultaneously opposite running toward each other can be automatically adjusted.

Figure 14:
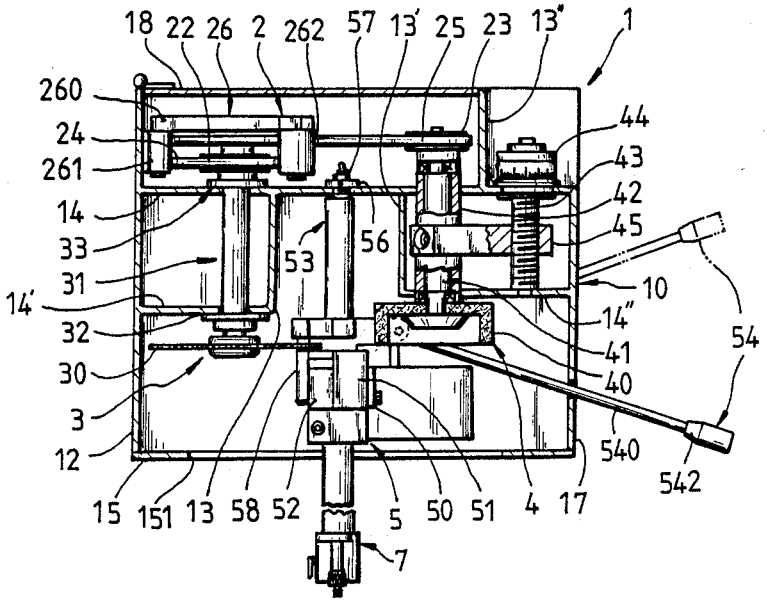
FIG. 14 shows a cross sectional view of the present invention in the cuting-off and end surface grinding positions and an optional view thereof to chuck or relase the rods.
Figure 15:
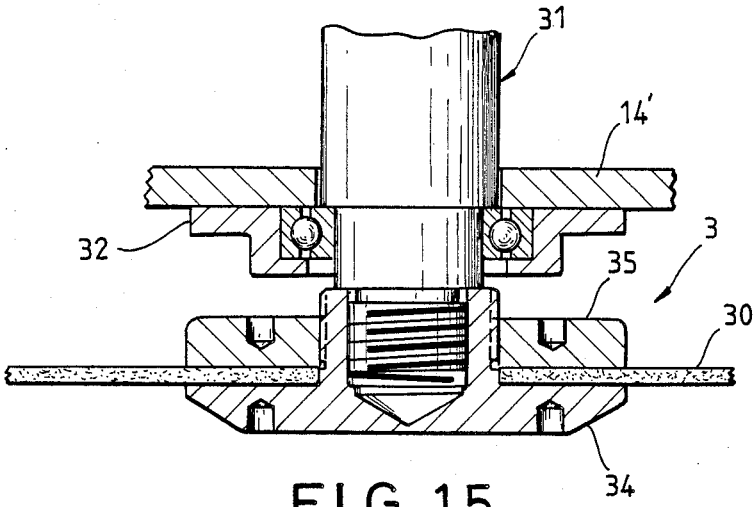
FIGS. 15 and 16 show an enlarged detail of partial longitudinal section of locking and cutting-off sander of sander drive shaft of the present invention and a partial front view thereof respectively.
Figure 16:
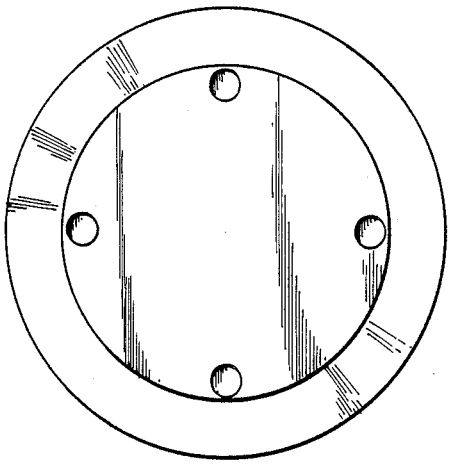

As shown in FIG. 14, the cut-off device 3 consists chiefly of a cut-off sander 30 locked on one end of a sander drive shaft 31 by a positioning nut 34 and a locking nut 35 (as shown in FIGS. 15 and 16) wherein the sander drive shaft 31 is installed between the two bearings 32, 33 with seats on the two lateral partitions 14, 14' on one inner side (left side) pivotally, and a single-grooved belt roller 22 of drive device 2 is installed on another end of said shaft 31 so that the cut-off device 3 can be driven by the drive device 2 for running and cutting off the rods.

As shown in FIG. 14, the end surface grinding device 4 consists chiefly of a cylindrical grinding sander 40, a cylindrical sander drive shaft 41, a crank hollow shaft 42, an adjusting stud 43, an adjusting knob 44 and a connecting plate 45, wherein the drive shaft 41 is pivotally installed in the crank hollow shaft 42 by two bearings and then the said shaft 42 is pivotally installed between the two lateral partitions 14, 14" on another inner side (right side) of said body 10, a cylindrical sander 40 is locked on one end of said drive shaft 41, and another single-grooved belt roller 23 of drive device 2 is installed on another end thereof so that the end surface grinding device 4 can be driven running by the drive device 2 for grinding; the said adjusting stud 43 is directly pivotally installed between the two partitions 14, 14" in the said body 10 on the outer side (right side) of said drive shaft 41, and an adjusting knob 44 is fixed on the outer end of said stud 43; one end of connecting plate 45 is connected to the crank hollow shaft 42, and another end thereof is in cooperation with the adjusting stud 43 so that when the adjusting knob 44 is rotated manually, the said shaft 42 together with the cylindrical sander 40 thereon can be adjusted to move to-and-fro to achieve the purpose of precisely grinding the end surface of a cut-off rod.

Figure 6:
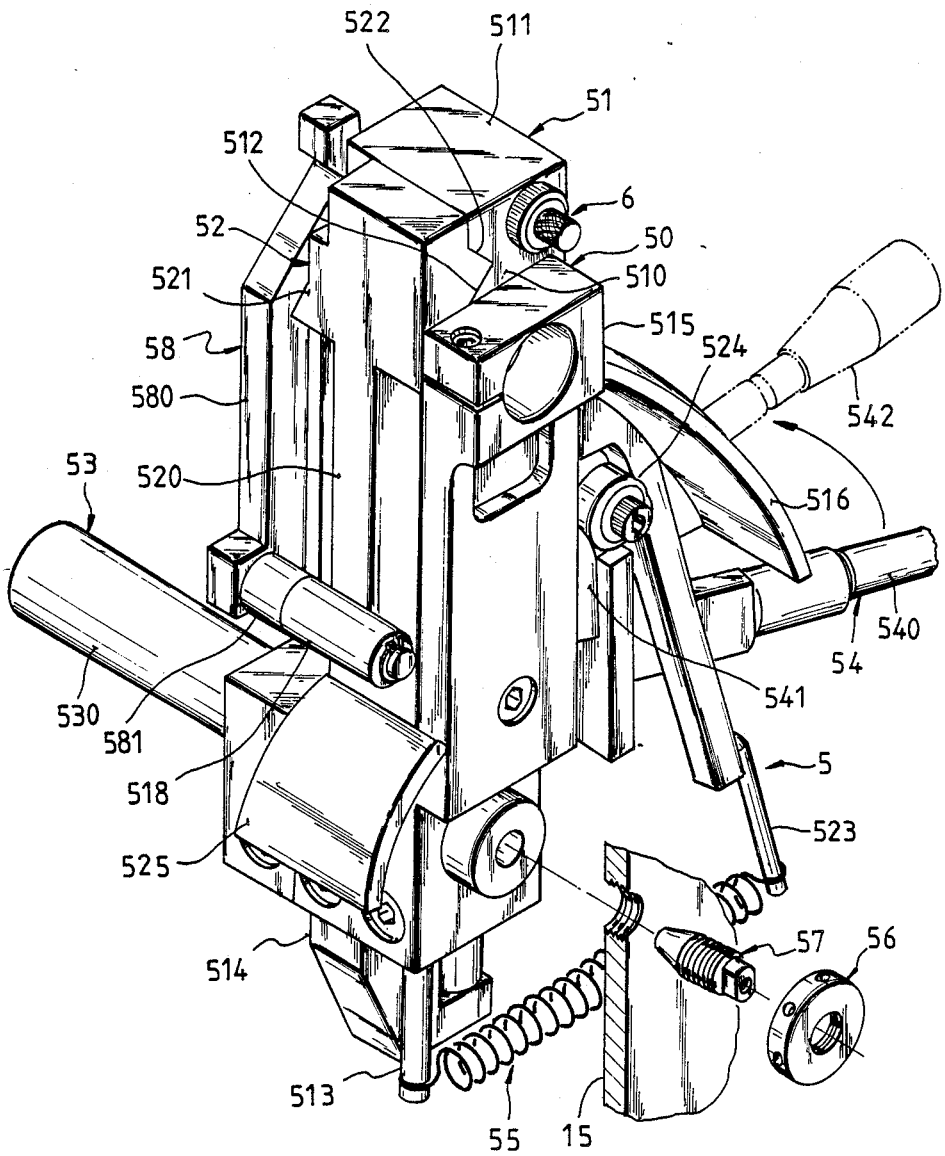
FIG. 6 is an elevational enlarged view of rods chucking device of the present invention.
Figure 11:
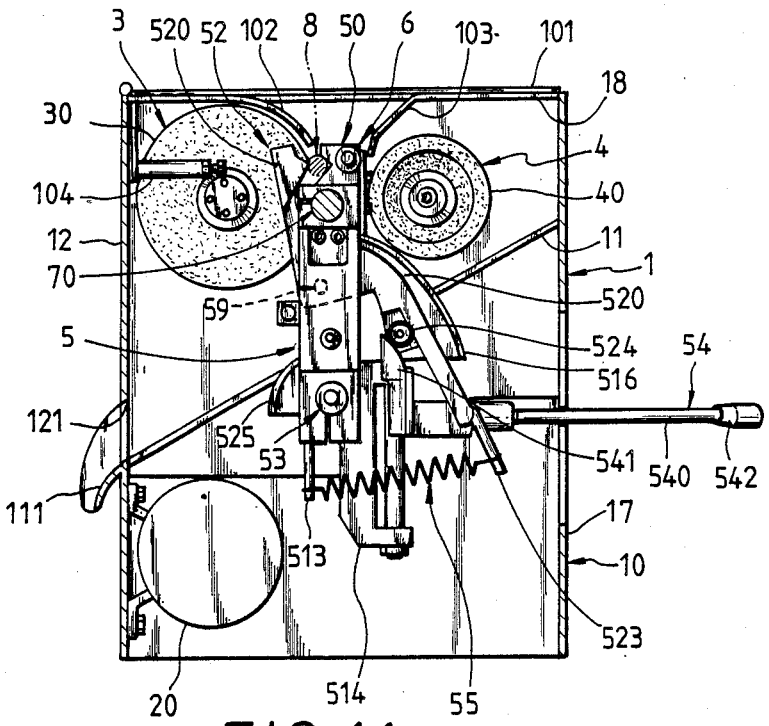
FIGS. 11, 12 and 13 show optional views of longitudinal sections of chucking rods, cut-off rods and end surface of ground rods of the present invention respectively.
Figure 12:
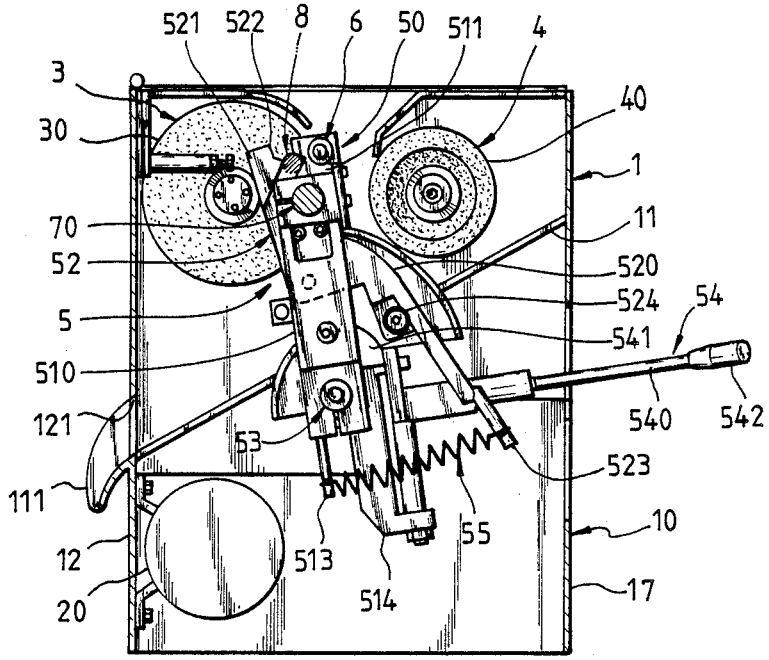
Figure 13:
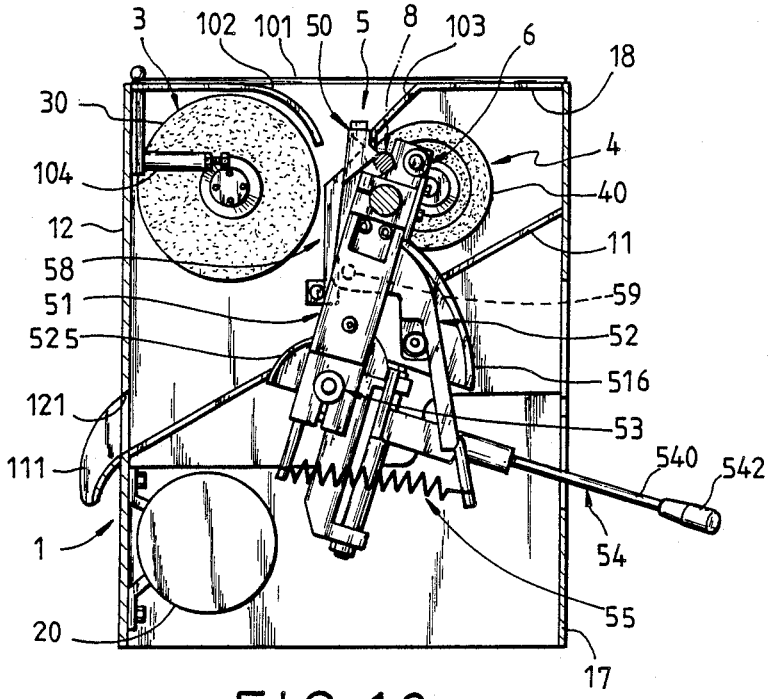

As shown in FIG. 6, the rods chucking device 5 consists chiefly of a primary chuck 51, a secondary chuck 52, a fixing shaft 53, a controlling lever 54, a chucking spring 55, and two sets each of tapered stud 56 and nut 57, wherein the primary chuck body 510 is a rectangular member with a slot centrally penetrating therethrough, the upper end of primary chuck 51 is provided with a chuck jaw 511 and a chuck mouth 512, and the lower end thereof is provided with an extension rod 513 for hanging the chucking spring 55; the secondary chuck body 520 is a roughly Z-member, the upper end of secondary chuck 52 is provided with a chuck jaw 521 and a chuck mouth 522 corresponding to the said jaw 511 and mouth 512, and the lower end thereof is also provided with an extension rod 523 for hanging the chucking spring 55. The secondary chuck body 520 is inserted in the central slot of primary chuck body 510 and pivotally installed by a pin shaft 59 (as shown in FIG. 11 through 13) so that the secondary chuck 52 may be on the primary chuck 51 to open and close as a pincer fixture 50; a chucking spring 55 with a strong pull (more than 10 kg at least) is installed between the two extension rods 513, 523 at the lower ends of said two chuck bodies 510, 520, so the said pull keeps the pincer fixture 50 in a chucking state to chuck the rods 8 (as shown in FIG. 11 through 13) for cutting off the rods and grinding the end surface of said rods. The fixing shaft 53 having a shaft body 530 with eye-let 531 at each of both ends is installed in a suitable position on the lower side of primary chuck body 510 of said pincer fixture 50 and parallels the edge of said chuck mouth 512; meantime, the two ends of said shaft body 520 are pivotally installed between the lateral partition 14 in the housing body 10 and the front side wall 15 of said body 10 by means of a tapered fixing stud 56 respectively; after adjusting a suitable tightness thereof, the said two ends are locked by an adjusting nut 57 respectively (as shown in FIG. 14) so that the said fixture 50 is between the cut-off device 3 and the end surface grinding device 4 (as shown in FIG. 2 and 11 through 13) and ready to cut off the rods 8 and to grind the end surface thereof in respect of the fixing shaft 53 in a manner of swinging the rods 8 left and right. The controlling lever 54 is a lateral T-lever body 540 pivotally installed on a U-frame 514 which is integrally made together with the primary chuck body 510 and the said lever 54 may swing from and return to its original position in respect of the U-frame 514 and along the T-slot 171 on the right side wall 17 of housing body 10 in a horizontal direction; an arcked inclined cam 541 is extended from or installed on the front end of said lever body 540, and a roller 524 or bearing is pivotally installed on the secondary chuck body 520, so that when the handle 542 at the tail end of controlling lever body 540 is manually held for swinging away in the horizontal direction, the arcked cam 541 thereon can force the roller 524 to move upward and actuate the secondary chuck body 520 to open its chuck mouth 522 and to put the rods 8 between the two chuck mouths 512, 522 of said pincer fixture 50 for cutting off and grinding operation, and then the controlling lever body 540 returns to its original position, the arcked cam 541 thereon will not force the roller 524 to move upward, the two chuck mouths 512, 522 of both primary and secondary chucks 51, 52 of said pincer fixture 50 are thus closed through entirely the pull of chucking spring 55 so as to chuck the rods 8 put between the said two mouths 512, 522 for cutting off and end surface grinding operation.

Figure 10:
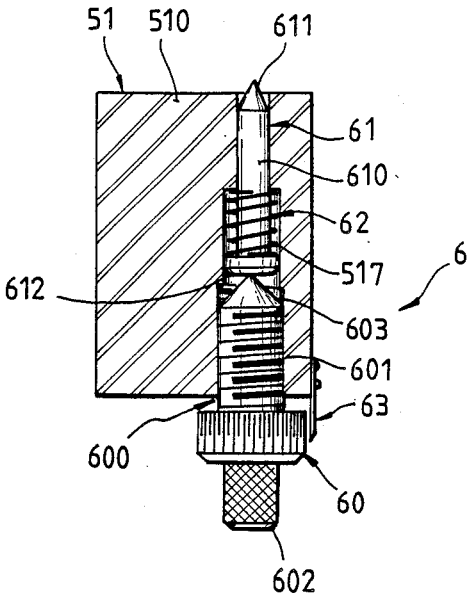
FIG. 10 is a cross sectional view of end surface grinding and flatening sander installed on the jaw of primary chuck of rods chucking device of the present invention.

In order to precisely cut off a rod 8 and grind its end surface, a projecting seat 515 (as shown in FIG. 6) may be installed in a suitable position on one side of primary chuck body 510 of pincer fixture 50 to mount a positioning rule device 7 for presetting a precise length of rods 8 to be cut off and so their end surface is to be ground; the said primary chuck body 510 is provided with a lateral stepped shaft hole 517 (as shown in FIG. 10) paralleling the chuck mouth 512 for installing a flattening device 6 of cylindrical grinding sander 40 so as to flatten the end surface of cylindrical sander 40; and a support rod 58 paralleling the chuck mouth 512 is pivotally installed on the primary chuck body 510 of pincer fixture 50 so that when the fixture 50 chucks and cuts off the rods 8, the cut-off and thrown-away end of rods 8 can still be supported by the support rod 58 and will fall down to the inclined partition 11 in the housing body 10 when the said end is entirely cut off, and the cut-off end surface of rods 8 will not have any residual and serious unevenness.

The support rod 58 is a rod body 580 corresponding to the shape of side edge of chuck mouth 512 of primary chuck body 510, the lower end of said rod 58 is provided with a pin rod 581 paralleling said chuck mouth 512 for pivotally installing in the pipe 518 preset on the primary chuck body 510, a spring (not shown in the drawing) is installed in the said pipe 518 to keep the support rod body 580 always against on the pin shaft 59 and parallel to the side edge of said chuck mouth 512 (as shown in FIG. 12, 13 and 14).

The cylindrical sander flattening device 6, as shown in FIG. 10, consists chiefly of an adjusting rod 60, a grinding rod 61, a spring 62 and a pointer 63, wherein the grinding rod 61 is a rod body 611 with a catcher 612 at tail end and a diamond tapered end welded at front end, and inserted from the end with larger diameter of lateral stepped shaft hole 517 preset on the primary chuck body 510 to the end with smaller diameter thereof, and in the spring 62; the adjusting rod 60 is a rod body 600 consisting of a terminal end with fine threaded tapered end 603 and a knob 602 with scale installed at another end of fine threaded stud 601, and threaded in the end with larger diameter of said lateral stepped shaft hole 517 so that the tapered end 603 just contacts the catcher 612 on the grinding rod body 610, when turning the knob 602 to move the adjusting rod body 600 forward a little bit, the grinding rod 61 can move forward, the diamond tapered end 611 can flaten the end surface of cylindrical sander 40 for grinding; then turning the knob 602 backward a little bit, the grinding rod 61 can withdraw through the elastic force of spring 62; the extent of moving ahead and back may be indicated by the pointer 510 installed on the primary chuck body 510 or the index of scale provided to the said body 510.

Figure 7:
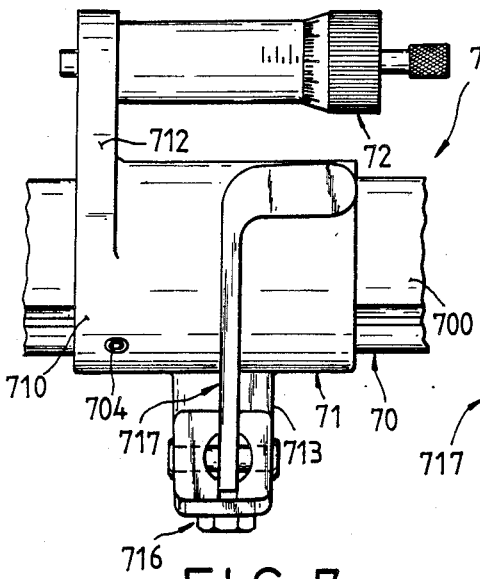
FIG. 7 is a side view of positioning rule of positioning rule device of the present invention.
Figure 8:
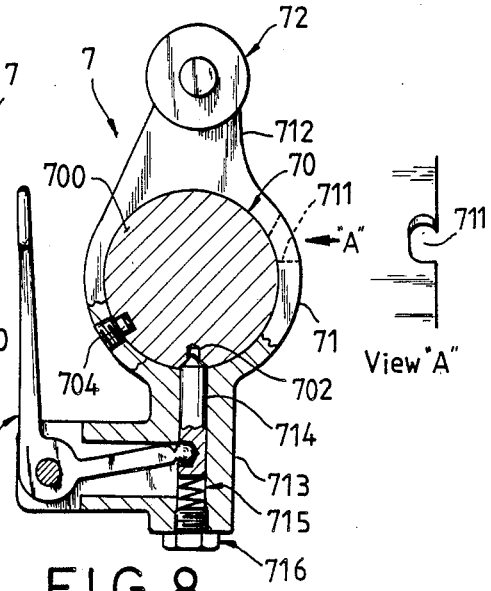
FIG. 8 is a cross sectional view of positioning rule of positioning rule device of the present invention.
Figure 9:
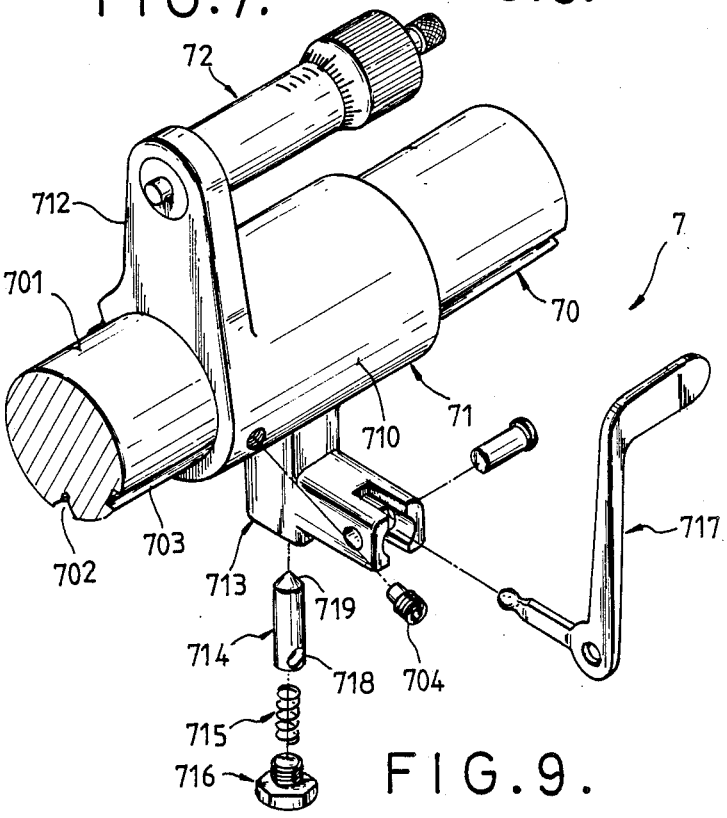
FIG. 9 is an elevational system view of positioning rule of positioning rule device of the present invention.

The positioning rule device 7, as shown in FIG. 1 to 3 and 7 to 9, is chiefly composed of a positioning set 71 capable of reciprocating movement and positioning action in a particular position is pivotally installed on a rule bar 70 and a micrometer bar 72 is installed on and parallel to the said positioning seat 71, wherein the rule bar 70 is provided with a plurality of metric or British system scales 701 and figures on its surface, and a bar body 700 with an axial key way 703 on one side of bar wall, and one each of funnel-shaped eyelet 702 is provided to the center of plane bar wall and a position corresponding to the said scales 701, a positioning screw 704 with roller at its front end is pivotally installed on the said positioning seat 71 and then locked on the projecting seat 515 of primary chuck 51 of rods chucking device 5; the positioning seat 71 consists of chiefly a projecting plate 712 and a L-projecting seat 713 at the upper and lower parts of a cylinder 710 with a window and a pointer. A micrometer bar 72 paralleling the bar body 700 is installed on the projecting plate 712 so as to help the positioning seat 71 for micro adjustment; a positioning pin 714 with a front tapered end 719 and a spring 715 are installed at the center of vertical bar body of L-projecting seat 713 and secured by a screw 716 or a plug, a L-lever 717 is pivotally installed at the terminal end of horizontal bar body thereof, and the horizontal end of said L-lever 717 is placed deep into the vertical bar body of L-projecting seat 713 to let its terminal end catch in the recess 718 preset at the rear end of positioning pin 714 so that when the vertical arm of L-lever 717 is manually moved, the positioning pin 714 can be actuated to move down but not inserted in any one funnel-shaped eyelet 702 on the bar body 700 for adjusting the movement of positioning seat 71 to-and-fro; and when the positioning seat 71 is moved to a position where the positioning pin 714 is just to be aligned with a certain funnel-shaped eyelet 702 and the vertical arm of L-lever 711 is manually released, the front tapered end 719 of positioning pin 714 is inserted in one of the funnel-shaped eyelets 702 on the rule body 700 without freely moving to-and-fro. In order to let the positioning seat 71 quickly and exactly move to the said fixed position during adjustment of moving to-and-fro, a pointer has to be provided to the edge of window 711 on the cylinder 710; meantime, in order to let the cylinder 710 pivotally installed on the rule bar 70 keep a fixed direction and a suitably adjusted tightness, it has to be pivotally installed in the cylinder 710 by a positioning screw 704 with a roller provided to the front end of said screw 704 (as shown in FIG. 7, 8 and 9).

Figure 4:
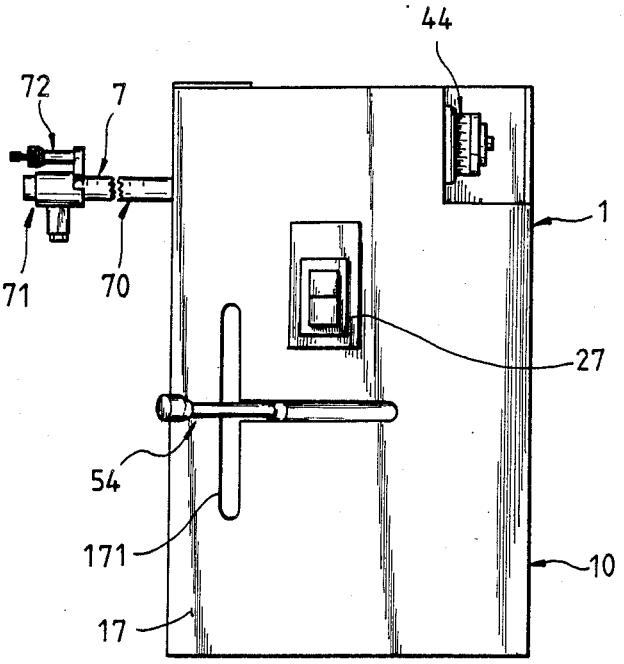
FIG. 4 is a right side view of the present invention.

What is mentioned above is a detailed description of the structure of rods precision cutting-off and end surface grinding machine of the present invention, now how to use the present invention and the characteristics and functions thereof are hereby described in detail hereinafter:

As shown in FIG. 4 and 11 through 14, when using the present invention for cutting off a rod 8 and grinding the end surface thereof, the controlling lever 54 of rods chucking device 5 is put in the central position of T-slot 171 on the right side wall 17 of housing body 10 (as shown in FIG. 4 and 14), then manually holding the handle 542 of said controlling lever 54 and moving said handle 542 along the right horizontal direction of T-slot 171 to a position indicated by the imaginary line as shown in FIG. 14 may let the arcked cam 541 at the front end of controlling lever 540 push the roller 524 pivotally installed on the secondary chuck body 520 to actuate the said chuck body 520 to open its chuck mouth 512, so that the rod 8 to be cut off and the end surface thereof to be ground are put between the two chuck mouths 512, 522 of pincer fixture 50 rods chucking device 5, then the said controlling lever 54 is moved back to its original position so that the primary and secondary chucks 51, 52 of said pincer fixture 5 can close its two mouths 512, 522 through the pull of chucking spring 55, the rod 8 can be chucked for cutting off and grinding its end surface (as shown in FIG. 11); then the handle 542 of controlling lever 54 is manually held to move upward and then downward along the T-slot 171 so that the pincer fixture 50 of rods chucking device 5 can chuck the rod 8 to be precisely cut by the cut-off sander 30 of cut-off device 3 (as shown in FIG. 12), and then the end surface of said rod 8 cut off is precisely ground by the cylindrical sander 40 of end surface grinding device 4 (as shown in FIG. 13); therefore, the precise length cut-off of a rod and the end surface grinding and flatening thereof can be finished at the same time. After cutting off the rod and grinding and flattening the end surface thereof, the controlling lever 54 of rods chucking device 5 is disposed in the central position of T-slot 171 on the right side wall 17 of housing body 10 and then moved in the horizontal direction along said T-slot 171 so as to open the two chuck mouths 512, 522 of pincer fixture 50 and remove the rod 8 which has been cut off and the end surface thereof has been ground, and the remainder of said rod 8 cut off can fall down to the inclined partition 11 in the housing body 10 and then out from the discharge hopper 111.

Since the rods precision cutting-off and end surface grinding machine of the present invention is particularly provided with a positioning rule device 7 on the primary chuck 51 of pincer fixture 50, when a rod 8 is cut off and the end surface thereof is ground, the rear end of said rod 8 may contact the micrometer bar 72 whereon the precise length has been preset, and then is chucked by the pincer fixture 50 of rods chucking device 5 for cutting off the rod 8 and grinding the end surface thereof, so the length of any one rod cut off with an end surface ground in such a way is quite precise. A displacement adjusting device consisting of an adjusting stud 43, an adjusting knob 44 and a connecting plate 45 is installed on one side of the end surface grinding device 4, and a set of cylindrical sander flatening device 6 is installed on the primary chuck 51 of pincer fixture 50, so the displacement of cylindrical sander 40 may be optionally adjusted for grinding and flattening the end surface of said sander in order to keep the end surface of said sander 40 flat in the precisely grinding position to smoothly and precisely grind the end surface of rod; in addition, a support rod 58 is provided to the primary chuck body 510 of pincer fixture 50, when the pincer fixture 50 chucks a rod 8 for cutting off, the thrown-away end of cut-off rod 8 can be supported by the support rod 58 till the said end is entirely cut off to fall, so the cut-off end of rod 8 will never have any remainder or serious unevenness in favor of further precisely grinding and flatening the end surface of a rod.

In view of the above, the design of rods precision cutting-off and end surface grinding machine of the present invention is perfect and the operation thereof is quite simple and convenient, so it is really a patentable invention.

We claim:

1. A rod precision cut-off and end surface grinding machine, comprising:

a housing, which is generally a rectangular housing body, consisting of an inclined plate in the shape of a ramp with a lower end extending to an outer side of a left side wall of the housing whereon a U-shaped discharge hopper with a supporting edge on two sides is installed, a plurality of longitudinal and lateral partitions, a notch provided to the upper side of a front side wall and an upper wall of said housing respectively, a T-slot provided to a right side wall thereof, and a rear cover plate capable of optional opening and closing pivotally installed on the back thereof;

a set of drive devices, consisting chiefly of a motor, a double-grooved drive belt roller, two single-grooved driven belt rollers, two transmission belts and a set of belt automatic tension adjusting devices, wherein the motor is installed on the lower side of a side wall of said housing body, the double-grooved drive belt roller is installed on the said motor, the two single-grooved driven belt rollers are installed on drive shafts of cut-off and end surface devices respectively and each device connected to the double-grooved drive belt roller by a belt, one end of said belt automatic tension adjusting device is pivotally installed on the inner side of a side wall of said housing body, and another end thereof is provided with a roller between the said two transmission belts;

a cut-off device, consisting chiefly of a cut-off sander installed on one end of a sander drive shaft by a positioning nut and a locking nut, wherein the sander drive shaft is pivotally installed between two lateral partitions on one side in the housing body, and another end thereof is provided with said single-grooved belt roller of said drive devices;

an end surface grinding device, consisting chiefly of a cylindrical grinding sander locked on one end of cylindrical sander drive shaft pivotally installed in a crank hollow shaft which is pivotally installed, together with the cylindrical sander drive shaft, between two lateral partitions on another side in the housing body, and another end of the cylindrical sander drive shaft is provided with said other single-grooved belt roller of said drive device; and a rod chucking device, consisting chiefly of a primary chuck, a secondary chuck, a fixing shaft, a controlling lever, a chucking spring, and two sets of tapered fixing stud and nut, wherein the primary chuck is generally a rectangular plate with a central slot penetrating therethrough, provided with a chuck jaw and a chuck mouth at an upper end, and an extension rod for securing the chucking spring at the lower end; the secondary chuck body is roughly a Z-shaped member, provided with a chuck jaw and a chuck mouth at an upper end, corresponding to the said jaw and mouth of primary chuck, and an extension rod at the lower end for securing the chucking spring, and inserted in the central slot of primary chuck body and pivotally installed by a pin shaft so that the secondary chuck cooperates with the primary chuck to open and close as a pincer fixture; the chucking spring is installed between the two extension rods at the lower ends of said two chuck bodies; the fixing shaft having eyelets at both ends is installed on the lower side of primary chuck body and parallels the edge of the mouth of primary chuck body, and the two ends of said shaft are pivotally installed between the lateral partition in the housing body and the front side wall of said housing body by means of a tapered fixing screw and an adjusting nut; the controlling lever is generally a T-lever body pivotally installed on a U-frame which is integrally made together with the primary chuck body, an arc-shaped inclined cam is installed on the front end of said lever body, and a roller is pivotally installed on the secondary chuck body;

which is chiefly characterized by the following operations: to put the controlling lever of the rod chucking device in the central position of T-slot on the right side of housing body and move the said lever in the right horizontal direction along the said slot so that the arc-shaped cam at the front end of said lever pushes the secondary chuck body to open its mouth to receive a rod, then to move the said lever back to its original position and then up and down along the said T-slot so that the pincer fixture of rod chucking device can chuck the rod to be precisely cut off by the cut-off device and then the end surface of said rod is precisely ground by the end surface grinding device, therefore, the rod can be precisely shortened and the end surface thereof can be ground and flattened at the same time.

2. A rod precision cut-off and end surface grinding machine as claimed in claim 1 wherein the belt automatic tension adjusting device of drive device has an L-rod capable of freely extending and folding, of which one end is pivotally installed on the bearing seat on the inner side of one side wall of housing body, and another end is provided with a movable roller between the two transmission belts of said drive device so that the tightness of said two belts with load during their running toward each other can be automatically adjusted.

3. A rod precision cut-off and end surface grinding machine as claimed in claim 1 or 2 wherein an adjusting stud with an adjusting knob at its outer end is pivotally installed between the two partitions in the housing body on the outer side of said end surface grinding device, and the said adjusting stud is engaged with a connecting plate connected to a hollow shaft of said end surface grinding device which is adjusted together with the cylindrical grinding snader installed thereon to move to-and-fro through turning the said knob for precisely grinding the cut-off end surface of the rod.

* * * * *